United States Patent [19]

Bordewijk

[11] Patent Number: 5,003,606

[45] Date of Patent: Mar. 26, 1991

[54] ANTIHOWLING HEARING AID

[75] Inventor: Lourens G. Bordewijk, Eindhoven, Netherlands

[73] Assignee: U.S. Philips Corporation, New York, N.Y.

[21] Appl. No.: 418,419

[22] Filed: Oct. 5, 1989

[30] Foreign Application Priority Data

Oct. 13, 1988 [NL] Netherlands ..... 8802516

[51] Int. Cl.[5] ..... H04R 25/00; H04R 3/02

[52] U.S. Cl. ..... 381/68.4; 381/68; 381/93; 381/95

[58] Field of Search ..... 381/93, 68, 68.4, 69, 381/83, 95, 71, 94

[56] References Cited

U.S. PATENT DOCUMENTS

| | | | |
|---|---|---|---|
| 3,922,488 | 11/1975 | Gabr | 381/93 |
| 4,109,116 | 8/1978 | Victoreen | 381/93 |
| 4,442,323 | 4/1984 | Yoshida et al. | 381/95 |

*Primary Examiner*—Jin F. Ng
*Assistant Examiner*—M. Nelson McGeary, III
*Attorney, Agent, or Firm*—Bernard Franzblau

[57] ABSTRACT

In order to prevent howling in a hearing aid (10) having a microphone (1), an amplifier (3) and a receiver (4) the hearing aid is provided with a second microphone (2) which is only sensitive to sound near to it. The microphones (1, 2) are connected to the amplifier (3) in antiphase relative to each other.

18 Claims, 1 Drawing Sheet

ANTIHOWLING HEARING AID

BACKGROUND OF THE INVENTION

This invention relates to a hearing aid having a microphone, an amplifier, an input coupled to the microphone and an output coupled to a receiver. The hearing aid also has means for suppressing unwanted feedback phenomena in the hearing aid.

Such a hearing aid is disclosed in U.S. Pat. No. 4,440,982. In the hearing aid described there the feedback phenomenon is obviated by suspending the receiver in a special manner in the hearing aid housing. As a result thereof, the mechanical-acoustic coupling between the receiver and the microphone is interrupted as effectively as possible, namely by reducing the mechanical transfer between the receiver and the hearing aid housing.

It has however been found that at high gain factors of the amplifier a feedback phenomenon still occurs sometimes in the hearing aid.

SUMMARY OF THE INVENTION

An object of the invention is to provide measures to obviate also in this case this feedback phenomenon in hearing aids in a simple and effective manner.

According to the invention, the hearing aid is characterized in that the feedback suppression means consisting of a second microphone which is only sensitive to sound close to it. This second microphone is coupled to a second input of the amplifier and both microphones are coupled to the associated inputs of the amplifier such that, when the output signals of the two microphones are applied to the respective amplifier inputs, for those output signals which are produced by sound close to the microphones, the amplifier does substantially not produce an output signal.

The invention is based on the recognition that the feedback phenomenon can sometimes also be caused by a direct acoustic coupling between the receiver and the microphone of the hearing aid, for example, due to the fact that the earmould in which the (in-the-ear) hearing aid is accommodated does not fit properly in the ear shell or in the auditory canal, or due to the venting ducts which are sometimes provided in the hearing aid. When a (close talking) microphone is used, for example a "noise-cancelling" microphone or a pressure gradient microphone, the signals which might be produced in response to the acoustic feedback when such a microphone is not present, are detected by both microphones and added together in anti-phase in the amplifier, and consequently are suppressed.

For signals which come "from close by" (for example, from the receiver) the combination of the two microphones and the amplifier has a suppressed effect. The close-talking microphone is substantially insensitive to "remote" signals. The hearing aid then operates in a normal manner since the remote signals captured by said microphone are amplified by the amplifier and applied to the receiver.

This produces an improved suppression of feedback phenomena. This means that higher gains in the hearing aid are made possible without howling occurring.

For an adequate suppression, the hearing aid is further characterized in that each one of the two microphones is acoustically coupled to a sound inlet aperture provided in the housing of the hearing aid, and that the two or more sound inlet apertures are positioned close to each other in the housing. Now, both microphones receive very similar acoustic signals so that the suppression of unwanted acoustic feedback signals is also improved.

Preferably, a threshold circuit is arranged between the microphone associated with the feedback suppression means and the amplifier. This means that only for signals having a value higher than a threshold value set in the threshold circuit, the threshold circuit transmits the signals to the amplifier. This actually means that the influence of the close-talking microphone is only noticeable at high signal amplitudes, that is to say the close-talking microphone "operates" only when it is really necessary, as howling can (will) occur only at high signal amplitudes. Put differently: high signal amplitudes are generally characteristic of howling, so that in this manner an adequate detection of howling is possible.

The hearing aid may further be characterized in that the two microphones are accommodated in a common microphone housing, that the housing is provided with two sound inlet apertures, one sound inlet aperture of which is acoustically coupled to one side of the diaphragm of both microphones and the other sound inlet aperture is acoustically coupled to the other side of the diaphragm of the microphone associated with the suppression means. In this manner a more accurate suppression of the feedback phenomenon can be realized.

It should be noted that the U.S. Pat. No. 4,456,795 discloses a hearing aid which also has two microphones. In that case no mention is made of suppression of an acoustic feedback phenomenon by means of adding together the signals, in anti-phase of the two microphones in the amplifier.

BRIEF DESCRIPTION OF THE DRAWING

Some embodiments of the invention will now be described in more detail with reference to the accompanying drawings, in which.

DESCRIPTION OF THE PREFERRED EMBODIMENTS

Figure 1:
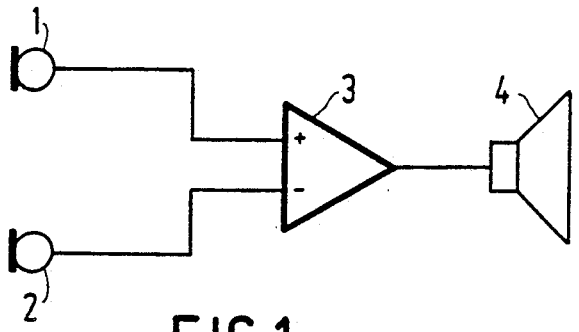
FIG. 1 shows a first.
Figure 3:
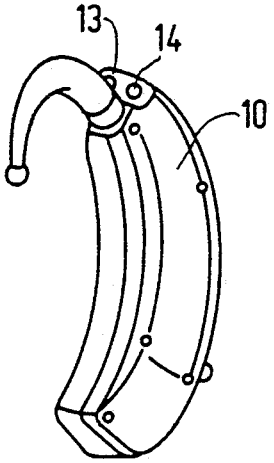
FIG. 3 a third embodiment of the hearing aid in accordance with the invention.

FIG. 1 is the electric circuit diagram of the hearing aid. The hearing aid may, for example, have the shape as shown in FIG. 3. A behind-the-ear hearing aid 10, which generally is in the shape of a banana, is then involved. This should not be seen as a limitation. The invention is equally applicable to, for example, in-the-ear hearing aids, that is to say hearing aids which can be fitted in the ear cavity and/or the auditory canal.

The hearing aid includes the customary microphone 1 which is coupled to an input, in this case to the non-inverting input of a (pre) amplifier 3. The output of this amplifier 3 is coupled to a receiver (loudspeaker) 4. The hearing aid has a second microphone 2 which is coupled to the inverting input of the amplifier 3.

The microphone 2 is what is commonly referred to as a close-talking microphone, i.e. a microphone which is only sensitive to acoustic signals from close by and is insensitive to remote acoustic signals. This type of microphone is alternatively denoted a "noise-cancelling"

microphone or "Nahbesprechungs" microphone. For example, a pressure gradient microphone might be used for this purpose. Actually, an embodiment of such a microphone is an arrangement of two microphones close to each other and connected in anti-phase. Such a microphone is already used in hearing aids, for which reference is made to said U.S. Pat. No. 4,456,795.

The two microphones 1 and 2 are preferably arranged close to each other in the hearing aid in a manner such that the sound inlet aperture of the two microphones are close to each other. This is necessary to ensure that substantially the same acoustic signals are applied to the two microphones 1 and 2 via the sound inlet apertures.

FIG. 3 shows two sound inlet apertures 13 and 14 which are arranged close to each other in the housing 10.

The hearing aid shown in FIG. 1 operates as follows. The microphone 2 is insensitive to the acoustic signals produced by a source remote from the hearing aid. The hearing aid then functions as a normal hearing aid where the remote acoustic signals received by the microphone 1 are reproduced by the receiver 4 after having been amplified.

For nearby acoustic signals, for example, the acoustic signals from the receiver 4 which, if received again by the microphone 1, would cause howling, the microphone 2 is indeed sensitive. Both microphones 1 and 2 now detect substantially the same close by signals so that after the signals have been opposedly combined in the differential amplifier 2, these detected signals are suppressed.

Figure 2:
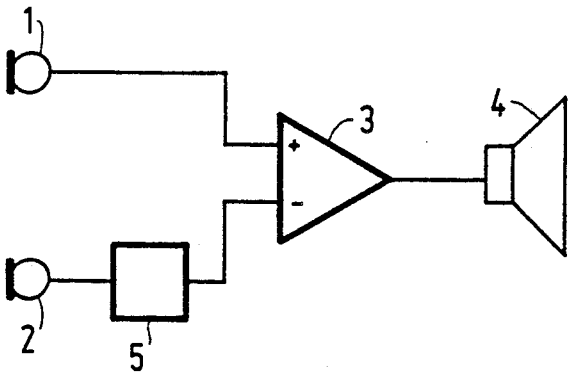
FIG. 2 a second.

An improved circuit is shown in FIG. 2 in which an additional element, more specifically a threshold circuit 5, is included between the microphone 2 and the amplifier 3.

Using this circuit 5, it is now possible to discriminate between desired "near" signals and unwanted "near" signals.

A desired signal is, for example, an intimacy whispered into the ear of the person wearing the hearing aid, which is experienced as a desired signal by the person wearing the hearing aid. Such a signal usually has a small amplitude. The signal supplied by the microphone 2 will consequently have such a low amplitude that the threshold in the threshold circuit 5 is not exceeded. The person wearing the hearing aid will therefore hear the desired signal which is of course also detected by the microphone 1.

An unwanted signal is an acoustic feedback signal of such a high amplitude that the threshold in the threshold circuit 5 is exceeded so that the suppressing action in the hearing aid is again realised.

The threshold circuit can be of a very simple structure. A controllable switch (not shown) can, for example, be provided in the lead from the microphone 2 to the inverting input. The signal from the microphone 2 is also applied to a mean value determining means (not shown), an output of which is coupled to an input of a comparator circuit (not shown). The threshold value is applied to a further input of the comparator circuit. If the average value of the microphone signal exceeds the threshold, the comparison circuit supplies a control signal which is applied to the control input of the controllable switch, in response to which the switch is closed.

Figure 4:
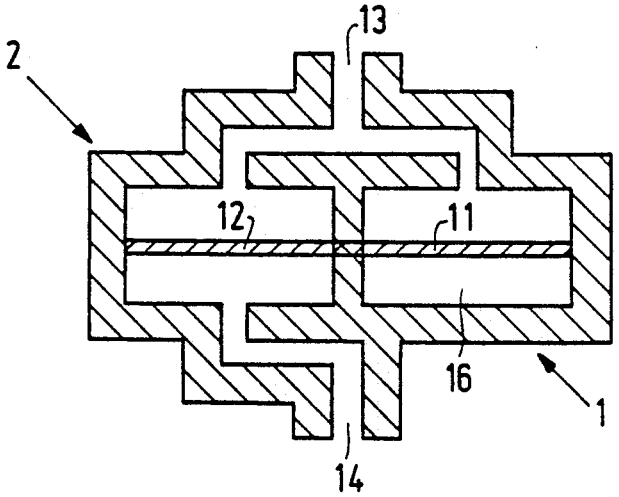
FIG. 4 shows an embodiment of a microphone combination.

FIG. 4 is a very schematic view of a combination of the two microphones 1 and 2.

Only the diaphragms 11 and 12 of the respective microphones 1 and 2 are shown. The mechanical-electric conversion is effected in known manner. An explanation thereof is not important since it is only the acoustic behaviour of the microphones that is involved. The microphone 1 is, for example, a normal-pressure microphone. To that end, the sound inlet aperture 13 is acoustically coupled to one side of the diaphragm 11. The space 16 at the other side of the diaphragm 11 is acoustically not coupled to the environment. The sound inlet aperture 13 is also coupled to one side of the diaphragm 12 of the microphone 2. In addition the sound inlet aperture 14 is acoustically coupled to the other side of the diaphragm 12.

I claim:

1. A hearing aid comprising; a microphone, an amplifier having a first input coupled to the microphone and an output coupled to a receiver, and means for suppressing unwanted feedback phenomena in the hearing aid including a second microphone which is only sensitive to sound close to it and is coupled to a second input of the amplifier, both said microphones being coupled to their respective inputs of the amplifier such that, when output signals of the two microphones are applied to the respective amplifier inputs, the amplifier substantially does not produce an output signal for components of said output signals produced by sound close to the second microphone.

2. A hearing aid as claimed in claim 1, wherein each one of the two microphones is acoustically coupled to a respective sound inlet aperture provided in the hearing aid housing, and wherein the two or more sound inlet apertures are provided close to each other in the housing.

3. A hearing aid as claimed in claim 2, wherein one microphone is connected to an inverting input and the other microphone to a non-inverting input of the amplifier.

4. A hearing aid as claimed in claim 1 wherein the second microphone comprises a "noise-cancelling" microphone.

5. A hearing aid as claimed in claim 1 further comprising a threshold circuit coupled between the second microphone and the amplifier.

6. A hearing aid as claimed in claim 1, wherein the two microphones are incorporated in a common microphone housing, the housing including two sound inlet apertures, one sound inlet aperture being acoustically coupled to one side of a diaphragm of the two microphones and the other sound inlet aperture being acoustically coupled to the other side of a diaphragm of the second microphone.

7. A hearing aid as claimed in claim 2, wherein the second microphone comprises a "noise-cancelling" microphone.

8. A hearing aid as claimed in claim 2, further comprising a threshold circuit coupled between the second microphone and the amplifier.

9. A hearing aid as claimed in claim 2, wherein the two microphones are incorporated in a common microphone housing, the housing including two sound inlet apertures, one sound inlet aperture being acoustically coupled to one side of a diaphragm of the two microphones and the other sound inlet aperture being acoustically coupled to the other side of a diaphragm of the second microphone.

10. A hearing aid comprising:

a first microphone sensitive to sounds originating both from a remote point and from a nearby point, a second microphone, different from the first microphone, and sensitive only to sounds originating from the nearby point, amplifier means having first and second inputs coupled to respective outputs of the first and second microphones, and having an output coupled to an electro-acoustic transducer, said amplifier means being operative to combine in a mutually neutralizing relationship first and second output signals received from the respective outputs of the first and second microphones such that a component of the output signal of the first microphone due to sounds received from the nearby point are cancelled out by the output signal of the second microphone which is due only to sounds received from said nearby point, whereby the electro-acoustic transducer develops an acoustic output substantially devoid of signal components due to sounds received from the nearby point.

11. A hearing aid as claimed in claim 10, wherein said amplifier means includes means for subtractively combining the first and second output signals received from the first and second microphones, respectively.

12. A hearing aid as claimed in claim 10, further comprising means for inhabiting passage of the second output signal from the second microphone to the amplifier means when the second output signal is below a given threshold level.

13. A hearing aid as claimed in claim 10, wherein said first and second microphones are contained in a common hearing aid housing including first and second sound inlet apertures located close to each other and acoustically coupled to said first and second microphones, respectively.

14. A hearing aid as claimed in claim 12, wherein said amplifier means comprises a differential amplifier in which said first and second inputs of the amplifier means comprise a non-inverting input and an inverting input, respectively, of said differential amplifier.

15. A hearing aid as claimed in claim 13, wherein the second microphone comprises a noise-cancelling microphone.

16. A hearing aid as claimed in claim 13, further comprising a threshold circuit coupled in cascade between the second microphone and the second input of the amplifier means.

17. A hearing aid as claimed in claim 10, wherein said first and second microphones are contained in a common hearing aid housing including first and second sound inlet apertures, one sound inlet aperture being acoustically coupled to one side of a diaphragm of the first and second microphones and the other sound inlet aperture being acoustically coupled to the other side of a diaphragm of the second microphone.

18. A hearing aid as claimed in claim 14, wherein said first and second microphones are positioned so as to receive substantially identical sound signals from said nearby point and said first microphone is coupled to said non-inverting amplifier input without any intervening elements which can vary the amplitude or phase of the first output signal.

* * * * *